United States Patent [19]

Thomas

[11] 3,977,574

[45] Aug. 31, 1976

[54] DISPENSING PIPETTE ACTUATOR SYSTEM

[76] Inventor: Bradley Scott Thomas, 2316 Harcroft Road, Timonium, Md. 21093

[22] Filed: May 29, 1975

[21] Appl. No.: 581,885

[52] U.S. Cl. ..... 222/391; 128/218 R

[51] Int. Cl.[2] ..... B67D 5/42

[58] Field of Search ..... 222/391, 309; 128/218 R, 218 P, 218 PA, 218 A

[56] References Cited

UNITED STATES PATENTS

| | | | |
|---|---|---|---|
| 1,270,835 | 7/1918 | Jersemann | 222/391 |
| 2,768,768 | 10/1956 | Cornell et al. | 222/391 X |
| 3,141,583 | 7/1964 | Mapel et al. | 222/309 |
| 3,517,668 | 6/1970 | Brickson | 222/309 X |

*Primary Examiner*—Allen N. Knowles
*Attorney, Agent, or Firm*—John F. McClellan, Sr.

[57] ABSTRACT

A manually manipulated plunger type pipet assembly including a detachably retained disposable lower unit comprising a pipet barrel assembly with a wiper-fitted plunger having an upward extension with a pair of opposed racks on the sides, a cylindrical actuator receives and retains the pipet barrel assembly and plunger extension, and engages the racks with respective trigger pawl and spring ratchet mechanisms except when an actuator clearing sleeve is slid over exposed portions of the racks to shield them from engagement by the pawl and ratchet to permit loading the pipet assembly; a two-position trigger stop affords a choice of stroke and thus of quantity dispensed per stroke.

11 Claims, 2 Drawing Figures

DISPENSING PIPETTE ACTUATOR SYSTEM

This invention relates generally to pipets and particularly to plunger-type pipets.

A principal object of this invention is to provide a pipet assembly of the type described which rapidly and reliably dispenses precise but adjustable aliquot parts in interruptable sequence at any desired intervals without need for oral actuation, employing a re-usable manual actuator and disposable pipets which co-act to prevent fouling of the actuator by liquids being dispensed.

Other objects are to provide a pipet as described which is more accurate than traditional pipets, which is less fatiguing in use than traditional pipets, which reduces the amount of operator training required, and which gives visible evidence of adjustment and operating positions.

Still further objects are to provide a pipet assembly as described which is economical to manufacture, durable, attractive in appearance and foolproof in operation.

In brief summary given for cursive-description purposes only the invention includes a trigger-advanced plunger actuator mechanism for dispensing from disposable pipets held in the actuator, and failsafe co-acting structure relating same.

The above and other objects and advantages of the invention will become more readily apparent from the following description, including the Figures, in which like parts are referred to by like reference numerals:

Figure 1:
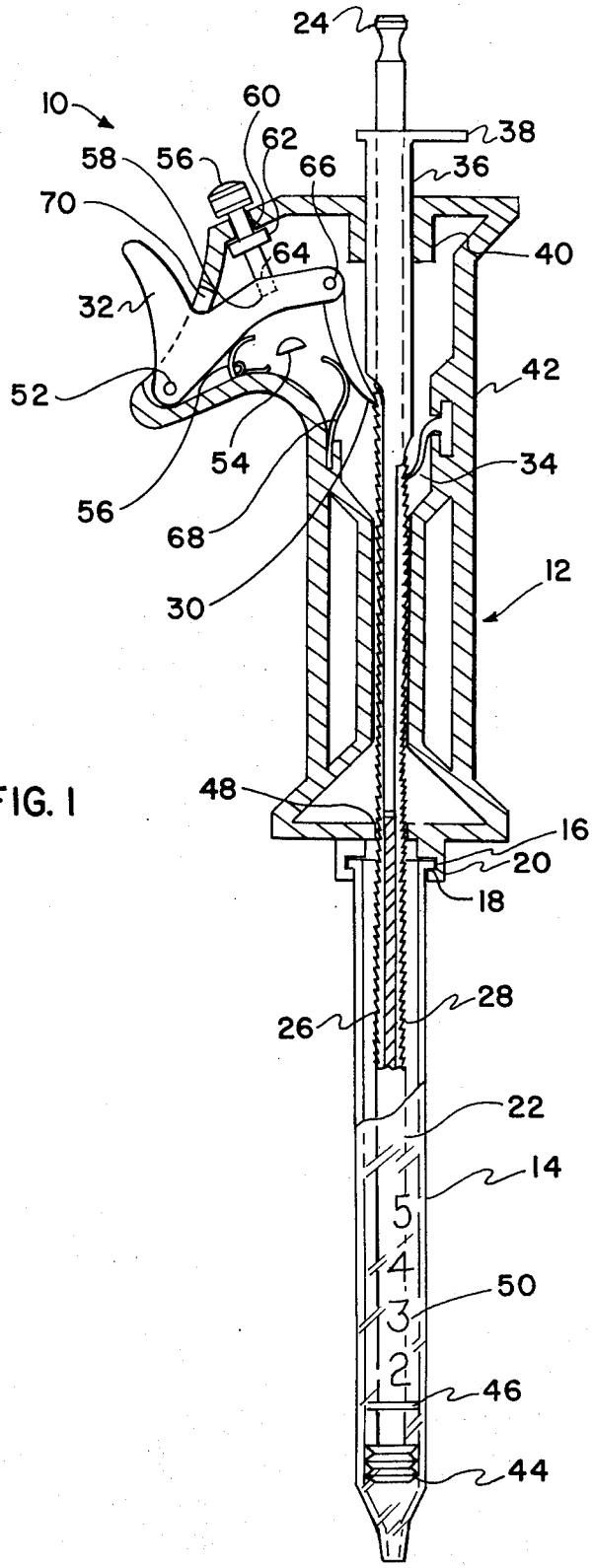
FIG. 1 is an elevation in section.
Figure 2:
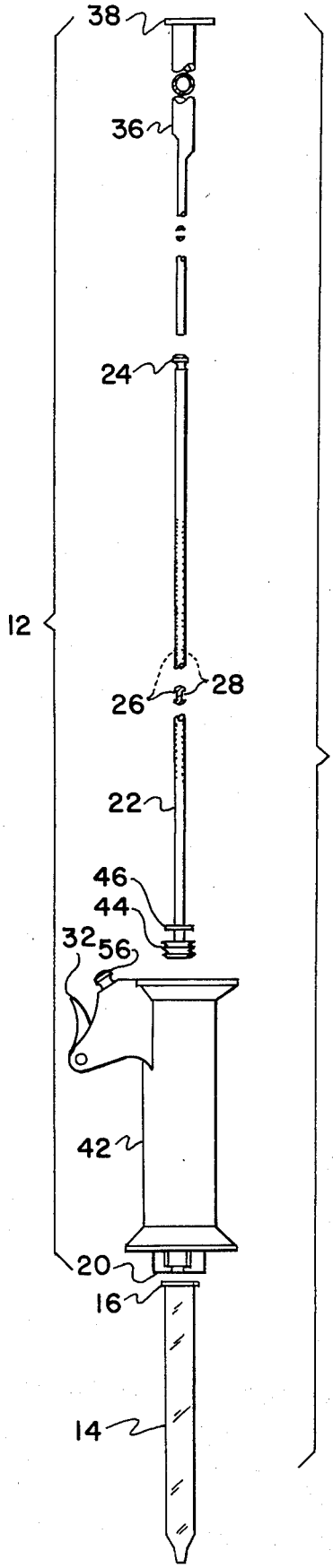
FIG. 2 is an elevation showing the two sub-assemblies of FIG. 1 disassembled.

Referring now to the Figures in detail, FIGS. 1 and 2 illustrate the invention 10, with the two components assembled in operating position, in FIG. 1 and disassembled in FIG. 2, the permanent unit or actuator 12 at the top holding the disposable unit or pipet barrel assembly below by means of outward circular flange 16 on the top of the pipet barrel. The flange is detachably gripped by respective internal grooves 18 in plural annularly-spaced, flexible, pipet-engaging fingers 20 extending downwardly from the lower end of the actuator.

Each disposable pipet barrel assembly includes assembled in it a plunger 22, of a length for extending from the bottom of the pipet barrel axially upward through the top of the actuator where it terminates in a gripping knob 24. Opposed sides of the plunger have upwardly-toothed racks 26, 28 on them respectively engageable by an actuator pawl 30 driven through a manually actuated trigger 32, and by a ratchet 34, for reasons which will be described. To prevent engagement of the racks by the pawl and ratchet, which would prevent assembling together the actuator and pipet barrel assembly, and would prevent filling the pipet, the actuator has a relatively movable actuator-clearing sleeve 36 which is depressed, interposing the clearing sleeve lower portions between the fingers and the racks, simultaneously freeing the plunger from the pawl and ratchet so that the plunger is freely movable up-and-down in the clearing sleeve until the clearing sleeve is raised. The upper part of the clearing sleeve is cylindrical and surrounds the plunger, and the lower part is bifurcate, exposing the opposed racks 26, 28, to action of the pawl 30 and ratchet 34 respectively. When fully depressed, the lower ends of the bifurcate portions of the clearing sleeve strike and eject flange 16 from the grip of fingers 20, releasing pipet barrel assembly 14. When the clearing sleeve is raised, the pawl and ratchet engage the respective racks. Operation of the clearing sleeve is by manipulation of the top-mounted clearing sleeve handle 38, and the clearing sleeve translates freely up and down in guides 40 in the actuator housing 42.

The plunger 22 terminates at the pipet end or lower end in a plurality of coaxial disk-shaped plunger wiping blades 44, preferably three. Each of these plunger wiping blades forms a tight running-fit with the bore of the pipet barrel, reducing the probability of leakage or blow-by during operation almost to zero.

An annular stop 46, integral with the plunger immediately above the topmost wiping blade, is proportioned for striking the actuator housing at the entrance hole 48 for the plunger at the bottom of the housing. This prevents the plunger from being withdrawn upwardly to a position in which the housing could be contaminated.

Operation is as follows. Once the actuator is loaded with a fresh pipet barrel assembly, thrust up from below and flexibly locked in place as indicated, the pipet is loaded with the fluid desired to be dispensed.

Loading is accomplished by immersing the tip of the pipet, depressing the actuator clearing sleeve to disengage the pawl and ratchet, and drawing the plunger upward by the knob until the desired level of fluid appears in the pipet barrel. Markings 50 on the pipet barrel exterior indicate the quantity of fluid held. Fluid held is dispensed in any of several modes chosen by the user.

First of all, if it is simply desired to expel a gross quantity without need for accurate measurement, the plunger is simply thrust down by hand to the degree required. This may be done at any time, with or without depression of the plunger clearing sleeve, since the fingers simply ratchet on the racks as the plunger is depressed.

To dispense precise aliquot portions, the user has only to grip the acutator in his hand and depress trigger 32, which pivots about pin 52 until it strikes fixed stop 54 on the housing. This forces the plunger down a precisely pre-determined distance each time the trigger is depressed. Return spring 56 thrusts the trigger upward to the initial position each time.

The initial position is adjustable by two-position stroke limit knob 57, to afford still further choice in predetermined dispensable quantities. The lower end 58 of the two-position stroke limit knob is forked. Thus, depending on the rotational setting of the knob in the mounting hole 60 in the housing, in which it is captured by protrusion 62, the return spring thrusts the trigger either against the fork ends 58 or against the throat 64 of the forked end, the difference in dimension being made to be at least one rack tooth. Thus, the user is afforded an instant choice at all times of trigger-dispensed aliquot portions.

The pivoting of pawl 30 at 66 to the trigger body provides a favorable positive downward pawling action in conjunction with spring 68 which maintains pawl contact. Spring ratchet 34 which seats in the housing and engages teeth of the opposite rack, positively prevents creepback or springback of the plunger, permitting the plunger wipers to be safely very tight, and permitting use with viscous and with springy (air charged) fluids.

The housing 42 has a hand-fitting overall cylindrical contour with a slot 70 in the top permitting access to the protrusive portion of the trigger and elsewhere shields the actuator mechanism except for the upper portion of the plunger clearing sleeve and the stroke limit knob.

The shape of the actuator mechanism, with the trigger adjacent the top in a guarding lateral protrusion of the housing permits the user to employ a pistol type grip, with forefinger on trigger 32, the other fingers of the hand surrounding the cylindrical portion of the actuator, and the thumb on clearing sleeve handle 38. This puts the hand well up out of the line of sight, in a comfortable, naturally forceful position. With elbow on table or other rest, the average person can maintain this position for long periods without wavering, and with hair-trigger control. The result, in combination with the other features of the invention, is to provide a combination of greater accuracy and speed than is possible with traditional pipets.

Suitable materials for the entire unit include transparent polystyrene or polyethylene permitting instant inspection of contents and positions, although other common materials will also be found suitable.

It will be apparent that the actuator design is such as to receive various sizes of pipet assemblies, and that operation is failsafe, since the actuator unit cannot be fouled by material dispensed so long as the pipet assembly is lower than the actuator unit.

It will be further apparent that the balancing of forces on the two sides of the rack equipped plunger permits the use of a lighter weight plunger as contrasted with the use of both pawl and ratchet on the same rack.

Obviously many modifications and variations of the present invention are possible in light of the above teachings. It is, therefore, to be understood that within the scope of the appended claims the invention may be practiced otherwise than as specifically described.

What is claimed and desired to be secured by United States Letters Patent is:

1. A pipet assembly comprising: a pipet barrel, a unitary plunger in the pipet barrel and having a portion extending upwardly therefrom, an actuator having a housing with a bore therethrough, means for attaching the actuator to the upper portion of the pipet barrel, with the upwardly extending portion of the plunger passing through the actuator housing bore and being of a length providing a manual grip above the actuator housing at any position of the plunger; the upwardly extending portion of the plunger having at least one rack therealong, and means in the actuator for pawling said rack and thereby forcing the plunger downward, including a trigger protrusive from the actuator, and means for simultaneously disposing of said pipet barrel and plunger downwardly from said actuator.

2. A pipet assembly as recited in claim 1, and means for preventing the plunger from rising after being forced downward by said means for pawling.

3. A pipet assembly as recited in claim 2, said means for preventing the plunger from rising including a second rack along the plunger upwardly extending portion substantially identical with the first said rack, and a spring ratchet located in the actuator housing in position for engaging the second rack.

4. A pipet assembly as recited in claim 3, wherein the first and second rack are on opposite sides of the plunger upwardly extending portion.

5. A pipet assembly as recited in claim 2, and movable sleeve means for simultaneously freeing the plunger from said means for pawling and from said means for preventing the plunger from rising.

6. A pipet assembly as recited in claim 5, the means for preventing the plunger from rising including a second said rack substantially identical with the first said rack along the plunger upwardly extending portion and a ratchet affixed to the actuator housing in position for engaging the second rack, the means for simultaneously freeing the plunger comprising a member movable within the actuator housing to a position simultaneously shielding all said racks from said pawling means and ratchet, and said movable member having a handle protrusive from said housing in coalignment with the upwardly extending portion of the plunger.

7. A pipet assembly as recited in claim 1, the means for attaching the actuator to the upper portion of the pipet barrel comprising a plurality of fingers extending downwardly from the housing, each having a groove therein, the pipet barrel having an exterior flange dimensioned to fit within the grooves of said fingers, at least one of all said fingers and flange being flexible.

8. A pipet assembly as recited in claim 7, the uppermost end of the plunger upwardly extending portion being in the form of a knob.

9. A pipet assembly as recited in claim 7, the end of the plunger within the pipet barrel comprising a plurality of circular wipers forming a plurality of slidable seals with the pipet barrel.

10. A pipet assembly as recited in claim 1, said trigger laterally protrusive from the upper portion of the actuator housing, said housing cylindrical therebelow in pistol-grip relation to the trigger for one-hand squeeze operation of the pipet assembly.

11. A pipet assembly as recited in claim 5, said means for disposing of the pipet barrel and plunger including: said movable sleeve means having a lower end movable downwardly for striking a portion of and downwardly ejecting said pipet barrel from said actuator.

* * * * *